US012085079B2

(12) United States Patent
Gao et al.

(10) Patent No.: US 12,085,079 B2
(45) Date of Patent: Sep. 10, 2024

(54) COMPRESSOR AND REFRIGERATION SYSTEM

(71) Applicant: GUANGDONG MEIZHI COMPRESSOR CO., LTD., Guangdong (CN)

(72) Inventors: Bin Gao, Guangdong (CN); Qiang Gao, Guangdong (CN); Yanhai Peng, Guangdong (CN); Gaimin Li, Guangdong (CN)

(73) Assignee: GUANGDONG MEIZHI COMPRESSOR CO., LTD., Guangdong (CN)

( * ) Notice: Subject to any disclaimer, the term of this patent is extended or adjusted under 35 U.S.C. 154(b) by 212 days.

(21) Appl. No.: 17/825,258

(22) Filed: May 26, 2022

(65) Prior Publication Data

US 2022/0290672 A1 Sep. 15, 2022

Related U.S. Application Data

(63) Continuation of application No. PCT/CN2020/136129, filed on Dec. 14, 2020.

(30) Foreign Application Priority Data

Oct. 14, 2020 (CN) ..... 202011097561.X

(51) Int. Cl.
*F04C 28/26* (2006.01)
*F04C 18/356* (2006.01)
*F04C 29/00* (2006.01)

(52) U.S. Cl.
CPC ..... *F04C 28/26* (2013.01); *F04C 18/3564* (2013.01); *F04C 29/0021* (2013.01)

(58) Field of Classification Search
CPC .... F04C 18/356–3564; F04C 28/24–26; F04C 29/0021; F04C 28/06; F16K 15/026–028
See application file for complete search history.

(56) References Cited

U.S. PATENT DOCUMENTS

2012/0174618 A1* 7/2012 Ogata ..... F04C 18/3564 418/268
2017/0030616 A1* 2/2017 Takada ..... F16K 15/026

FOREIGN PATENT DOCUMENTS

CA 3137384 A1 * 3/2020 ..... F04C 18/356
CN 1191958 A 9/1998
(Continued)

OTHER PUBLICATIONS

International Search Report dated Jul. 15, 2021 received in International Application No. PCT/CN2020/136129 together with an English language translation.
(Continued)

*Primary Examiner* — Alexander B Comley
(74) *Attorney, Agent, or Firm* — Scully, Scott, Murphy & Presser, P.C.

(57) ABSTRACT

A compressor and a refrigeration system are provided. The compressor has a shell, an air cylinder assembly and a pressure relief device. The shell has a containing cavity. The air cylinder assembly is disposed in the containing cavity, and has an air suction cavity and a pressure relief channel. The pressure relief channel communicates with the air suction cavity and the containing cavity, and has a pressure relief opening. The pressure relief device is connected with the air cylinder assembly. The pressure relief device moves in the axis direction of the pressure relief channel, so as to open or close the pressure relief opening.

13 Claims, 5 Drawing Sheets

(56) References Cited

FOREIGN PATENT DOCUMENTS

| | | | | | |
|---|---|---|---|---|---|
| CN | 2784623 | Y | | 5/2006 | |
| CN | 1896524 | A | | 1/2007 | |
| CN | 103511261 | A | * | 1/2014 | |
| CN | 104728116 | A | * | 6/2015 | |
| CN | 111322240 | A | * | 6/2020 | ..... F04C 18/3562 |
| JP | H0245673 | A | * | 2/1990 | |
| JP | 03213679 | A | * | 9/1991 | |
| JP | H11-50979 | A | | 2/1999 | |
| JP | 2002-227789 | A | | 8/2002 | |
| JP | 2010-174674 | A | | 8/2010 | |
| KR | 100608866 | B1 | * | 8/2006 | |
| WO | WO-2019045656 | A1 | * | 3/2019 | ..... F04C 18/3564 |

OTHER PUBLICATIONS

First Office Action dated May 6, 2021 received in Chinese Patent Application No. CN 202011097561.X together with an English language translation.

Second Office Action dated Aug. 18, 2021 received in Chinese Patent Application No. CN 202011097561.X together with an English language translation.

* cited by examiner

COMPRESSOR AND REFRIGERATION SYSTEM

CROSS-REFERENCE TO RELATED APPLICATIONS

This application is a continuation application of PCT International Patent Application No. PCT/CN2020/136129, filed on Dec. 14, 2020, which claims priority to and benefits of Chinese Patent Application No. 202011097561.X filed with China National Intellectual Property Administration on Oct. 14, 2020 and entitled "Compressor And Refrigeration System", the entire contents of which are herein incorporated by reference for all purposes. No new matter has been introduced.

FIELD

The present disclosure relates to the field of compressors, and in particular, to a compressor and a refrigeration system.

BACKGROUND

In a refrigeration device, when a compressor can be restarted after it is shut down since the last operation, the compressor can be restarted more reliably only when the pressure difference between an air suction side and an air exhaust side of the compressor reaches a certain required range. Especially, for a rolling rotor compressor, the pressure difference must reach a relatively small value, e.g., below 1 kgf/cm$^2$; otherwise the compressor cannot be started, which renders that the effective operation of the refrigeration device cannot be achieved temporarily.

Generally, when a refrigeration device is shut down, the balance between the high pressure and the low pressure of a heat exchanger can be quickly achieved through a throttling component, and then the pressure difference between the air suction side and the air exhaust side of the compressor is balanced, and the compressor can be restarted. However, in some refrigeration systems, the throttling component is closed when the refrigeration systems are shut down, or the refrigeration devices are equipped with a stop valve on the air suction side or the air exhaust side of the compressor which is closed when they are shut down. As a result, the pressure balance between the air suction side and the air exhaust side of the compressor can only be achieved gradually through the leakage from the clearance in the compressor when the refrigeration systems are shut down. In this case, on the one hand, the duration for balancing will be prolonged, and this may not meet the requirement for the time interval for restarting after the system is shut down, and on the other hand, in the case of leakage through the clearance, the leakage will be very slow when the pressure difference between the air suction side and the air exhaust side is relatively small, and the requirement cannot even be met that the pressure difference between the air suction side and the air exhaust side is less than the balance pressure for starting the compressor due to the sealing effect of lubricating oils, thereby resulting in difficulty in starting the compressor.

In related art, there is a method of using a starting component called "hard start kit" to increase the starting torque of the compressor when the pressure balance is not reached and then help start the compressor, but there is still a requirement for the upper limit of the pressure difference for starting. Meanwhile, when a rotor compressor is started with a pressure difference, it has problems in start modes and power consumption, which is not conducive to the reliable operation of the compressor and the system.

SUMMARY

The present disclosure aims to solve at least one of the technical problems in the prior art or related art.

Thus, according to a first aspect of the present disclosure, a compressor is provided.

According to a second aspect of the present disclosure, a refrigeration system is provided.

In view of this, according to the first aspect of the present disclosure, a compressor is provided. The compressor comprises a shell, an air cylinder assembly and a pressure relief device. The shell comprises a containing cavity. The air cylinder assembly is disposed in the containing cavity. The air cylinder assembly comprises an air suction cavity and a pressure relief channel, the pressure relief channel communicates with the air suction cavity and the containing cavity, and the pressure relief channel comprises a pressure relief opening. The pressure relief device is connected with the air cylinder assembly. The pressure relief device moves in the axis direction of the pressure relief channel, so as to open or close the pressure relief opening. The through-flow area of the pressure relief device satisfies: $0<Sz\leq 0.8\times S$, wherein Sz represents the through-flow area of the pressure relief device and S represents the area of the cross section of the pressure relief channel.

The compressor provided by the present disclosure comprises the shell, the air cylinder assembly and the pressure relief device. The air cylinder assembly is provided with the air suction cavity and the pressure relief channel. When moving with respect to the pressure relief channel, the pressure relief device can close or open the pressure relief opening in the pressure relief channel, to balance the pressures in the air suction cavity of the air cylinder assembly and the shell. Through limiting the through-flow area of the pressure relief device, the product of the perimeter of the pressure relief opening and the displacement of the pressure relief device is greater than zero and is less than or equal to 0.8 time the area of the cross section of the pressure relief channel, and a fluid flowing from a high-pressure side to a low-pressure side is throttled, so that the pressure distribution of the fluid at two sides of the pressure relief device is conducive to the stability of the pressure relief device. Therefore, the duration for restarting the compressor after the compressor is shut down can be greatly shortened, which facilitates restarting the refrigeration system and improves the effect of the refrigeration system.

For example, when the compressor is shut down and is in a pre-set time period, and the actual pressure difference between the air suction cavity and the containing cavity is relatively large, the pressure relief device does not need to open the pressure relief channel at this moment. When the compressor is closed and goes beyond the pre-set time period, the actual pressure difference decreases gradually, and the efficiency of adjusting the pressure difference also lowers gradually, and at this moment, the pressure relief device leaves the pressure relief opening to open the pressure relief channel. Thus, the efficiency of adjusting the pressure difference is improved, and subsequently the pressure in the containing cavity and the pressure in the air suction cavity are adjusted rapidly to quickly reach a balance between them, thereby meeting the condition for restarting the compressor. The integral efficiency of adjusting the pressure difference of the compressor depends on the configuration and the number of the pressure relief channels, and on parameters such as the actual pressure difference and the viscosity of the fluid.

It needs to be explained that the areas of different cross sections of the pressure relief channel can be the same as or different from each other. When the multiple cross sections of the pressure relief channel have different areas, S is the minimum area of the cross sections of the pressure relief channel.

In addition, the area of the pressure relief opening can be the same as or can also be different from the area of the cross section of the pressure relief channel, and this can be arranged reasonably according to the requirement for the flowing of the fluid.

In the above embodiment, furthermore, the pressure relief channel comprises a first pressure relief channel having a first end and a second end and a second pressure relief channel having a first end and a second end. The first end of the first pressure relief channel communicates with the air suction cavity. The first end of the second pressure relief channel communicates with the second end of the first pressure relief channel. The second end of the second pressure relief channel communicates with the containing cavity. The pressure relief device is located between the first pressure relief channel and the second pressure relief channel. The through-flow area satisfies: $0<Sz\leq 0.8\times S1$, wherein Sz represents the through-flow area of the pressure relief device and S1 represents the area of the cross section of the first pressure relief channel.

In this exemplary embodiment, the pressure relief device can be disposed at one end of the pressure relief channel, which is connected with the containing cavity, or at the middle of the pressure relief channel so as to divide the pressure relief channel into a high pressure relief channel and a low pressure relief channel. When the pressure relief device is positioned at the middle of the pressure relief channel, the pressure relief channel comprises a first pressure relief channel and a second pressure relief channel. The first pressure relief channel communicates with the air suction cavity, the second pressure relief channel communicates with the containing cavity, and the first pressure relief channel communicates with the second pressure relief channel through the pressure relief device. Through the pressure relief device, the ability of the compressor in adjusting the pressure difference between the two pressure relief channels can be improved, thereby quickly achieving the pressure balance of the compressor and thus meeting the needs of restarting a rotary compressor.

Furthermore, the fluid flowing from a high-pressure side to a low-pressure side is throttled by limiting a circumferential through-flow area, so that the pressure distribution of the fluid at two sides of the pressure relief device is conducive to the stability of the pressure relief device. Therefore, the duration for restarting the compressor after the compressor is shut down can be greatly shortened, so as to achieve a quick-start function of the compressor and improve the effect of a refrigeration system.

In any one of the above embodiments, furthermore, the pressure relief device comprises a pressure relief piece and an elastic piece. The pressure relief piece is moveably disposed on the pressure relief opening at the containing cavity side of the pressure relief channel. The elastic piece is connected with the air cylinder assembly and the pressure relief piece. The elastic piece is configured to drive the pressure relief piece to move, so as to open or close the pressure relief opening.

In this exemplary embodiment, the movement of the pressure relief piece is controlled through the elastic piece. When the actual pressure difference between the air suction cavity and the containing cavity is greater than the elastic force of the elastic piece, the pressure relief piece is pushed by the pressure in the containing cavity, so that the pressure relief piece contacts the pressure relief opening and the pressure relief channel is closed. When the actual pressure difference between the air suction cavity and the containing cavity is smaller than the elastic force of the elastic piece, the elastic piece pushes the pressure relief piece in a direction that the pressure relief piece is away from the pressure relief opening, so that the pressure relief channel is opened, and with the movement of the pressure relief piece, the pressure relief piece gradually moves away from the pressure relief opening. Thus, the pressure in the containing cavity and the pressure in the air suction cavity can be adjusted rapidly and a pressure balance between them is reached, thereby meeting the condition for restarting the compressor.

In any one of the above embodiments, furthermore, the pressure relief device further comprises a position-limiting piece connected with the air cylinder assembly. The position-limiting piece is used to limit the position of the pressure relief piece along the axis direction of the pressure relief channel.

In this exemplary embodiment, a second position can be determined through the elastic force of the elastic piece, and a position-limiting piece can also be disposed on the air cylinder assembly, and the position of the pressure relief piece in the axis direction of the pressure relief channel is limited through the position-limiting piece, thereby preventing the pressure relief piece and the elastic piece from flying out and limiting the displacement of the pressure relief piece, and therefore, the stability of the pressure relief device in a pressure relief process is ensured.

For example, the position-limiting piece can be a retainer ring structure, or a limit block structure.

In any one of the above embodiments, furthermore, the pressure relief piece is provided with at least one through-flow hole therein.

In this exemplary embodiment, when the pressure relief piece has the maximum displacement relative to the pressure relief opening, the pressure relief piece reaches the position-limiting piece, as it circumferentially contacts the position-limiting piece, this makes flow difficult. Therefore, in order to ensure the smooth circulation of the pressure relief channel, one or more through-flow holes are disposed in the pressure relief piece, and then this can not only ensure that no leakage occurs when the pressure relief piece is closely attached to the pressure relief opening, but also ensure that the circulation effect of the pressure relief channel can still be achieved through the through-flow holes when the position-limiting piece is in contact with the pressure relief piece.

For example, the through-flow holes are disposed outside the contact portion of the pressure relief piece and the pressure relief opening and inside the contact portion of the pressure relief piece and the position-limiting piece. In other words, the arrangement of the positions of the through-flow holes can satisfy both the area of the pressure relief piece that does not communicate with the pressure relief opening when the pressure relief piece closes the pressure relief channel, and the area that is not in contact with the position-limiting piece when the pressure relief piece is in contact with the position-limiting piece.

In any one of the above embodiments, furthermore, along the axis direction of the pressure relief channel, the pressure relief channel is disposed with a protruding structure that protrudes towards the containing cavity, the protruding structure comprises a platform that is close the containing cavity, and the platform is disposed with the pressure relief opening.

In this exemplary embodiment, through disposing the protruding structure on the pressure relief channel, the pressure relief opening protrudes relative to the air cylinder assembly. When the pressure relief piece closes the pressure relief opening, since the pressure relief opening protrudes from peripheral steps, the pressure relief piece can effectively contact the pressure relief opening, thereby preventing the tilting of the pressure relief piece from affecting the effect that the pressure relief piece closes the pressure relief channel. The height of the protruding structure can be reasonably arranged according to the requirements for production or pressure adjustment.

In any one of the above embodiments, furthermore, as the pressure relief piece closes the pressure relief opening, the elastic piece is compressed; and the elastic force of the elastic piece satisfies: $0<Ft\leq a\times m^2$, or $0<Ft\leq b\times(m+n)^2$, wherein, Ft represents the elastic force of the elastic piece, m represents the diameter of the pressure relief opening, n represents the diameter of the platform, the value range of a is 0.6~0.9, and the value range of b is 0.15~0.25.

In this exemplary embodiment, as the elastic piece is compressed by the high-pressure side of the pressure relief device, the pressure relief piece gradually approaches the pressure relief opening until the pressure relief opening is closed. When the pressure relief piece closes the pressure relief opening, at this moment, if the diameter of the pressure relief opening is equal to the diameter of the platform, and the pressure relief piece is in line contact with the platform, and the elastic force Ft (unit: N) of the elastic piece satisfies: $0<Ft\leq a\times m^2$, where m (unit: mm) represents the diameter of the pressure relief opening, and the value range of a is 0.6~0.9; if the diameter of the pressure relief opening is smaller than the diameter of the platform, and the pressure relief piece is in surface contact with the platform, the elastic force Ft of the elastic piece satisfies: $0<Ft\leq b\times(m+n)^2$, wherein m represents the diameter of the pressure relief opening, n represents the diameter of the platform, and the value range of b is 0.15~0.25. Thus, full consideration is given to the pressure difference for controlling the pressure relief piece to open the pressure relief channel, i.e., the pressure difference between the inner space of the containing cavity and the air suction cavity. The greater the pressure difference between the inner space of the containing cavity and the air suction cavity is, the greater the elastic force of the elastic piece should be. The conditions that affect the design of the elastic force also include factors such as the viscous force of a lubricating oil existing between the pressure relief piece and the platform when the pressure relief piece contacts the pressure relief opening. By limiting the elastic force of the elastic piece, the pressure relief device can meet the requirement for achieving rapid pressure balance after the compressor is shut down in various application situations of refrigerating and heating, so that the compressor can meet the requirements of different application situations, thereby solving the problem of restarting after the compressor is shutdown.

Furthermore, if the elastic force of the elastic piece is designed relatively large, it means that a relatively large pressure difference is required to make the pressure relief piece close the pressure relief channel. In other words, if the pressure difference of the compressor in an operating condition is smaller than the pressure difference for closing the pressure relief piece, and the pressure relief piece is also in an open state while the compressor is operating, this will cause collusion of the high pressure and the low pressure of the compressor and thus affect the operating efficiency of the compressor. For example, for a compressor operating in a working condition with a small pressure difference, a can be set to 0.6, that is, the elastic force Ft of the elastic piece can be set to satisfy $0<Ft\leq 0.6\times m^2$, orb is set to 0.15, i.e., $0<Ft\leq 0.15\times(m+n)^2$; for a compressor used in normal working conditions, a can be set to 0.9, that is, the elastic force Ft of the elastic piece can be set to satisfy $0<Ft\leq 0.9\times m^2$, or b is set to 0.25, i.e., $0<Ft\leq 0.25\times(m+n)^2$. Therefore, the requirement is met that the pressure relief piece is in a closed state in most operating conditions of the compressor, and the requirement for the balance between the high-pressure side and the low-pressure side of a compressor within a specified time limit can also be met after the compressor is shut down, thereby accommodating considerations to both the requirements for the operating efficiency and the pressure balance of the compressor.

In any one of the above embodiments, furthermore, the displacement L of the pressure relief device satisfies: $0<L\leq 1$ mm.

In this exemplary embodiment, after the pressure relief piece leaves the pressure relief opening, the acting force of the elastic piece on the pressure relief piece will decrease as the displacement of the pressure relief piece increases. If the acting force changes sharply, it will cause relatively large differences between multiple pressure differences required by the pressure relief piece to close the pressure relief channel when the pressure relief piece is at different positions, and then lead to unstable movement of the pressure relief piece, and further cause problems, such as impact, abrasion and noise. Therefore, the maximum displacement between the pressure relief piece and the pressure relief opening of the pressure relief device cannot be overly large, and then by setting the displacement L of the pressure relief device to satisfy: $0<L\leq 1$ mm, the stability of the pressure relief piece during movement is ensured so as to facilitate quick decompressing.

In any one of the above embodiments, furthermore, the shell is provided with an air suction opening; the air cylinder assembly comprises an air cylinder and a bearing; the air cylinder is disposed inside the containing cavity, the bearing is disposed at two sides of the air cylinder, the air cylinder and the bearing enclose the air suction cavity, and the air suction cavity communicates with the air suction opening; the pressure relief channel is disposed in the air cylinder and the bearing; and the pressure relief device is connected with the air cylinder or the bearing.

In this exemplary embodiment, the air cylinder is disposed inside the containing cavity, and the air cylinder comprises an air cylinder body, a slider, a piston and an eccentric crankshaft. The piston is disposed in the air cylinder body, and the eccentric crankshaft passes through the air cylinder body. The bearing is connected to the two sides of the air cylinder and the eccentric crankshaft is supported by the bearing. The air cylinder and the bearing enclose the air suction cavity, and the air suction cavity communicates with the air suction opening in the shell, so as to discharge the refrigerant inside the air suction cavity out of the shell. The pressure relief device is connected with either the air cylinder or the bearing, and the pressure relief device can be disposed at either side of the air suction cavity, or at both sides of the air suction cavity at the same time. Therefore, through the revolution of the piston and the reciprocating motion of the slider, the process of air intaking, compressing and exhausting of the compressor is realized, that is, a working cycle is accomplished.

For example, when the compressor stops working, the piston stops at a position in the air cylinder body, and the piston is in clearance fit with the air cylinder body, so that the pressure in the containing cavity and the air suction cavity can be adjusted through the clearance between the piston and the air cylinder body. In a refrigerating application, a refrigerant gas can be leaked from the clearance to balance the pressure in the compressor, and the refrigerant gas is leaked from a side with a relatively high pressure to a side with a relatively low pressure so as to balance the pressure; it may also be the situation that the oil at the side with a relatively high pressure is leaked to the side with a relatively low pressure, and a refrigerant dissolved in the oil escapes, so as to increase the ambient pressure at the side with a relatively low pressure, so that the pressure of the compressor is balanced.

In any one of the above embodiments, furthermore, the air cylinder assembly further comprises a silencer connected with the bearing. The silencer and the bearing enclose a silencing cavity; and the pressure relief channel communicates with the air suction cavity and the silencing cavity.

In this exemplary embodiment, the silencer is disposed on the bearing, and the silencer and the bearing can enclose the silencing cavity. By disposing the silencer to reduce the noise produced during adjusting the pressures in the air suction chamber and the containing cavity, the discomfort caused to users during the application of the compressor is lowered, and the practicability of the compressor is improved.

According to the second aspect of the present disclosure, a refrigeration system is provided. The refrigeration system comprises a compressor provided in the first aspect and a heat exchanger connected with the air suction cavity of the compressor. Therefore, the refrigeration system has all the beneficial effects of the compressor provided in the first aspect, which will not be repeated herein.

In the above embodiment, furthermore, the refrigeration system further comprises a non-return piece, wherein the non-return piece is configured to block the refrigerant in the air suction cavity from being discharged out of the shell of the compressor through the air suction opening of the compressor.

In this exemplary embodiment, the refrigeration system further comprises the non-return piece, since the non-return piece is configured to block the refrigerant in the air suction cavity from being discharged out of the shell of the compressor through the air suction opening of the compressor, the pressure in the shell is prevented from being discharged through the air suction opening, which is conducive to maintenance of pressure, and helps to realize the pressure adjusting function of the compressor.

BRIEF DESCRIPTION OF THE DRAWINGS

In order to more clearly illustrate the embodiments in embodiments provided by the present disclosure or in the prior art, a brief introduction will be given hereinafter to the accompanying drawings that may be used in the description of the embodiments or in the prior art. Apparently, the drawings in the description below only relate to some embodiments of the present disclosure, and other drawings may be obtained by those of ordinary skilled in the art according to these drawings without paying any creative labor.

Figure 1:
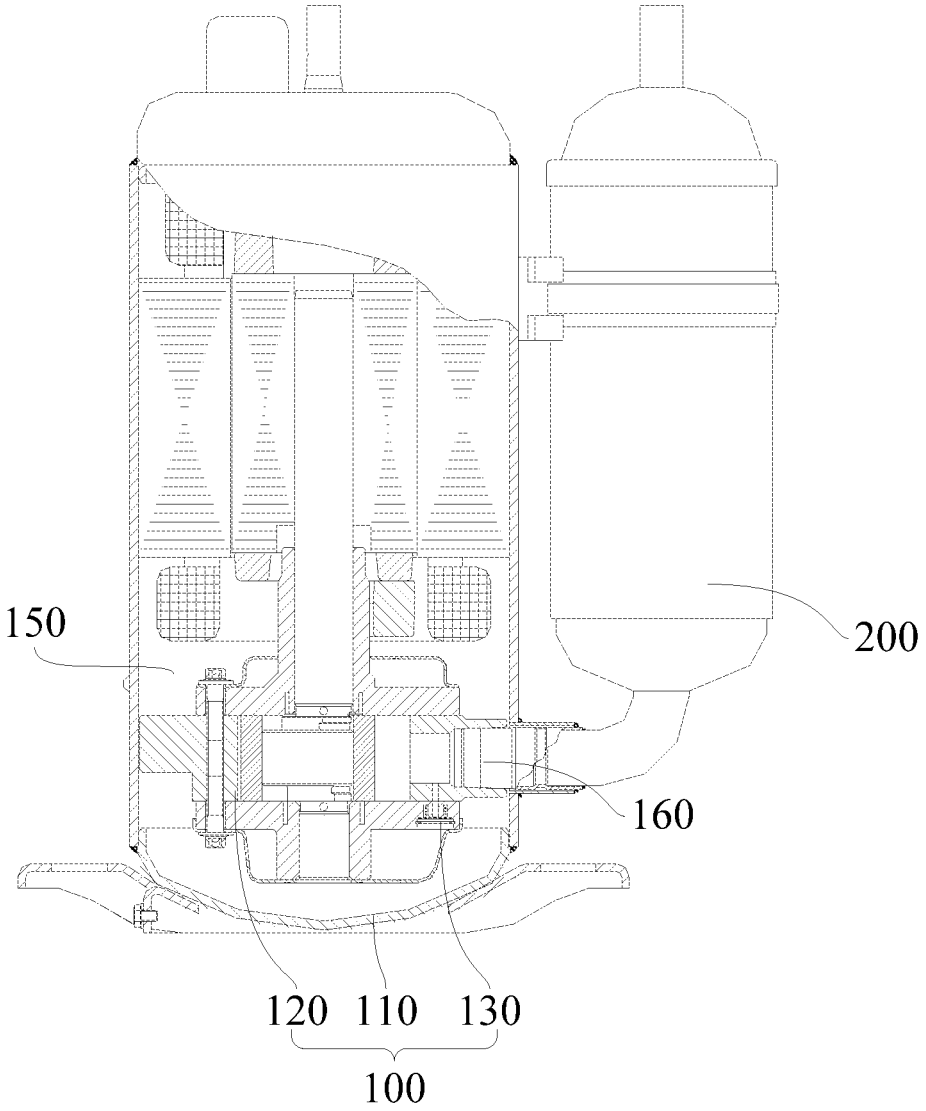
FIG. 1 is a schematic view of the structure of a refrigeration system according to an embodiment of the present disclosure.

The reference numerals shown in the figures are described as follows:

100 compressor, 110 shell, 120 air cylinder assembly, 122 air cylinder, 1222 air cylinder body, 1224 piston, 1226 eccentric crankshaft, 124 bearing, 126 pressure relief channel, 1262 first pressure relief channel, 1264 second pressure relief channel, 1266 protruding structure, 128 silencer, 130 pressure relief device, 132 pressure relief piece, 134 elastic piece, 136 position-limiting piece, 138 through-flow hole, 140 base, 150 containing cavity, 160 air suction cavity, 200 heat exchanger.

The implementations of objects of the present disclosure, and the functions, features and advantages of the present disclosure will be further described below in combination with the embodiments and with reference to the accompanying drawings.

DETAILED DESCRIPTION OF EMBODIMENTS

In order that the above-mentioned objectives, features and advantages of the present disclosure can be understood more clearly, a further detailed description of the present disclosure will be given below in connection with the accompanying drawings and specific embodiments. It should be noted that the embodiments of the present disclosure and the features in the embodiments can be combined with each other if there is no conflict.

In the following description, numerous specific details are set forth in order to provide a thorough understanding of the present disclosure. However, the present disclosure can also be implemented in other manners than those described herein. Therefore, the protection scope of the present disclosure is not limited to the specific embodiments disclosed below.

Hereinafter, a compressor and a refrigeration system according to some embodiments of the present disclosure will be described with reference to FIGS. 1-7.

Figure 2:
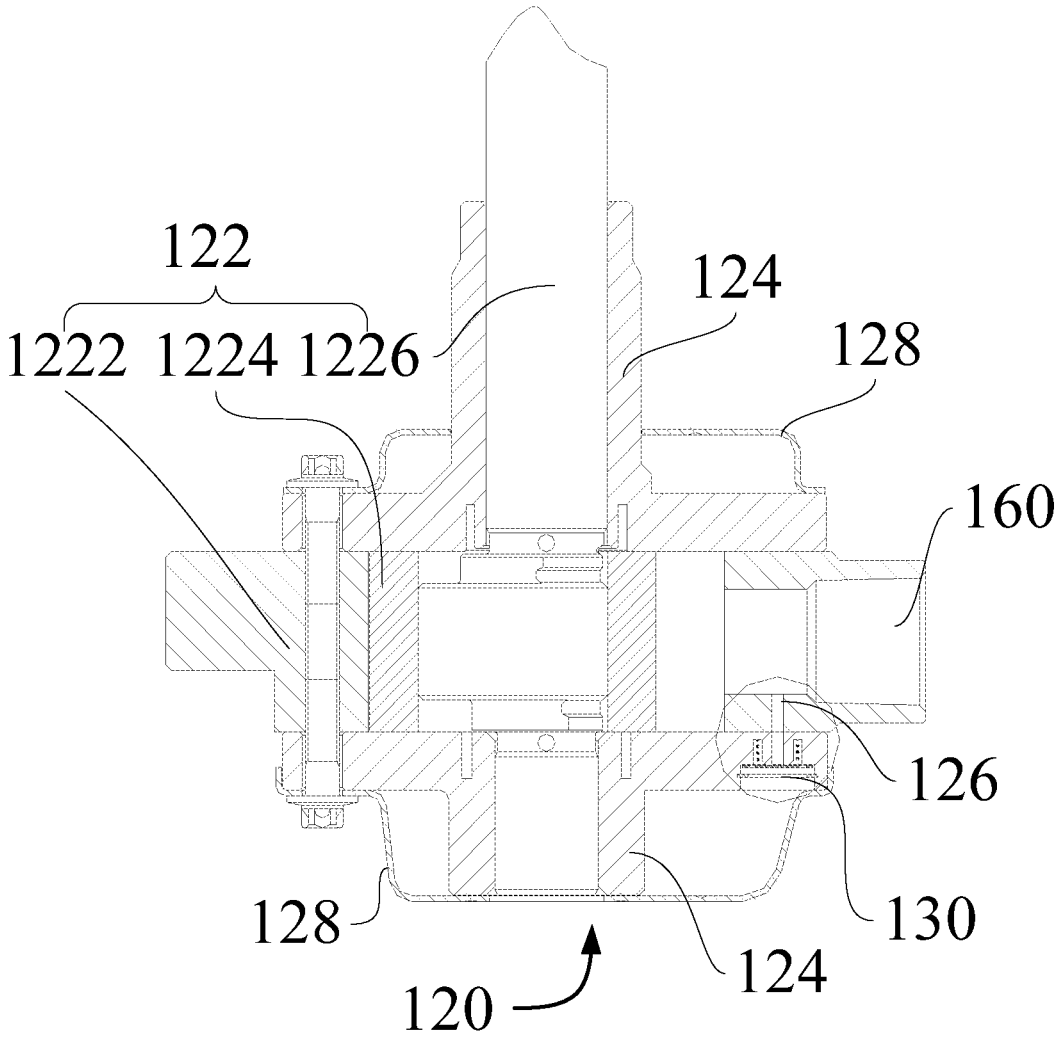
FIG. 2 is a schematic view of the structure of an air cylinder assembly of a compressor according to an embodiment of the present disclosure.

As shown in FIG. 1 and FIG. 2, according to an exemplary embodiment of the first aspect of the present disclosure, a compressor 100 is provided, and the compressor 100 comprises a shell 110, an air cylinder assembly 120 and a pressure relief device 130.

For example, the shell 110 encloses a containing cavity 150, and the shell 110 is provided with an air suction opening that is connected with a heat exchanger 200. The air cylinder assembly 120 is located inside the containing cavity 150, and the air cylinder assembly 120 is provided with an air suction cavity 160 and a pressure relief channel 126. The air suction cavity 160 is connected with the air suction opening to discharge a refrigerant in the air suction cavity 160 out of the shell 110. The pressure relief channel 126 communicates with the air suction cavity 160 and the containing cavity 150, and has a pressure relief opening 1268. The pressure relief device 130 is connected to the air cylinder assembly 120, and the pressure relief device 130 moves along the axis direction of the pressure relief channel 126 and has a first position and a second position. If the pressure relief device 130 is at the first position, the pressure relief device 130 contacts the pressure relief opening 1268 to block the pressure relief opening 1268. As the pressure relief device 130 moves from the first position to the second position, the pressure relief device 130 opens the pressure relief opening 1268. If the pressure relief device 130 is at the second position, the pressure relief device 130 moves a maximum displacement in a direction from the air suction cavity 160 to the containing cavity 150, that is, the second position is the farthest position to which the pressure relief device 130 can move. The circumferential through-flow area of the pressure relief device 130 is represented by Sz, the area of the cross section of the pressure relief channel 126 is represented by S, when the pressure relief device 130 is at the second position, the circumferential through-flow area Sz satisfies: $0<Sz\leq 0.8\times S$. For example, the circumferential through-flow area of the pressure relief device 130 satisfies: $Sz=L\times Z$, wherein, L represents the displacement of the pressure relief device 130, i.e., a distance that the pressure relief device 130 moves from the first position to the second position, and Z represents the perimeter of the pressure relief opening 1268.

In this exemplary embodiment, the compressor 100 comprises the shell 110, the air cylinder assembly 120 and the pressure relief device 130, and the pressures in the air suction cavity 160 of the air cylinder assembly 120 and the shell 110 are balanced through the pressure relief device 130, and the fluid flowing from a high-pressure side to a low-pressure side is throttled by limiting a circumferential through-flow area, so that the pressure distribution of the fluid at two sides of the pressure relief device 130 is conducive to the stability of the pressure relief device 130. Therefore, the duration for restarting the compressor 100 after the compressor is shut down can be greatly shortened, so as to facilitate the re-operation of a refrigeration system and improve the effect of the refrigeration system.

For example, when the compressor 100 is shut down and is in a pre-set time period, and the actual pressure difference between the air suction cavity 160 and the containing cavity 150 is relatively large, the pressure relief device 130 does not need to open the pressure relief channel 126 at this moment. When the compressor 100 is closed and goes beyond the pre-set time period, the actual pressure difference decreases gradually, and the efficiency of adjusting the pressure difference also lowers gradually, and at this moment, the pressure relief device 130 leaves the pressure relief opening 1268 to open the pressure relief channel 126. Thus, the efficiency of adjusting the pressure difference is improved, and then the pressure in the containing cavity 150 and the pressure in the air suction cavity 160 are adjusted rapidly to quickly reach a balance between them, thereby meeting the condition for restarting the compressor 100. The integral efficiency of adjusting the pressure difference of the compressor 100 depends on the construction and the number of the pressure relief channels 126, and on parameters such as the actual pressure difference and the viscosity of the fluid.

It needs to be explained that the areas of different cross sections of the pressure relief channel 126 can be the same as or different from each other. When different cross sections of the pressure relief channel 126 have different areas, the circumferential through-flow area is greater than zero, and is less than or equal to 0.8 time the minimum area of the cross section of the pressure relief channel 126.

In addition, the area of the pressure relief opening 1268 can be the same as or can also be different from the area of the cross section of the pressure relief channel 126, and this can be arranged reasonably according to the requirement for the flowing of the fluid.

As shown in FIGS. 3-7, another exemplary embodiment according to the present disclosure may comprise the features defined in any one of the above embodiments, and furthermore, the pressure relief channel 126 comprises a first pressure relief channel 1262 and a second pressure relief channel 1264.

For example, the first end of the first pressure relief channel 1262 communicates with the air suction cavity 160, and the second end thereof communicates with the first end of the second pressure relief channel 1264. The second end of the second pressure relief channel 1264 communicates with the containing cavity 150. The pressure relief device 130 is disposed between the first pressure relief channel 1262 and the second pressure relief channel 1264 to communicate or block the fluid in the first pressure relief channel 1262 and the second pressure relief channel 1264. If the pressure relief device 130 is at the second position (i.e., the farthest position that the pressure relief device 130 can move to), at this moment, the pressure relief device 130 can fully open the pressure relief opening 1268 at the second end of the first pressure relief channel 1262, and the high pressure in the second pressure relief channel 1264 flows through the pressure relief opening 1268 to the first pressure relief channel 1262. In addition, when the pressure relief device 130 is at the second position, the product of the perimeter of the pressure relief opening 1268 at the second end of the first pressure relief channel 1262 and the displacement of the pressure relief device 130 from the first position to the second position, i.e., the circumferential through-flow area Sz of the pressure relief device 130, satisfies: $0<Sz\leq 0.8\times S1$, wherein S1 represents the area of the cross section of the first pressure relief channel 1262.

In this exemplary embodiment, the pressure relief device 130 can be disposed at one end of the pressure relief channel 126 which is connected with the containing cavity 150, or at the middle of the pressure relief channel 126 so as to divide the pressure relief channel 126 into a high pressure relief channel and a low pressure relief channel. When the pressure relief device 130 is positioned at the middle of the pressure relief channel 126, the pressure relief channel 126 comprises the first pressure relief channel 1262 and the second pressure relief channel 1264. The first pressure relief channel 1262 communicates with the air suction cavity 160, the second pressure relief channel 1264 communicates with the containing cavity 150, and the first pressure relief channel 1262 communicates with the second pressure relief channel 1264 through the pressure relief device 130. Through the pressure relief device 130, the ability of the compressor 100 in adjusting the pressure difference between the two pressure relief channels 126 can be improved, thereby quickly achieving the pressure balance of the compressor 100 and then meeting the needs of restarting a rotary compressor 100. Furthermore, the fluid flowing from a high-pressure side to a low-pressure side is throttled by limiting a circumferential through-flow area, so that the pressure distribution of the fluid at two sides of the pressure relief device 130 is conducive to the stability of the pressure relief device 130. Therefore, the duration for restarting the compressor 100 after the compressor 100 is shut down can be greatly shortened, so as to achieve a quick-start function of the compressor 100 and improve the effect of a refrigeration system.

For example, the area of the cross section of the first pressure relief channel 1262 is the same as or different from the area of the cross section of the second pressure relief channel 1264, which can be disposed reasonably according to the requirement for pressure adjustment.

Figure 3:
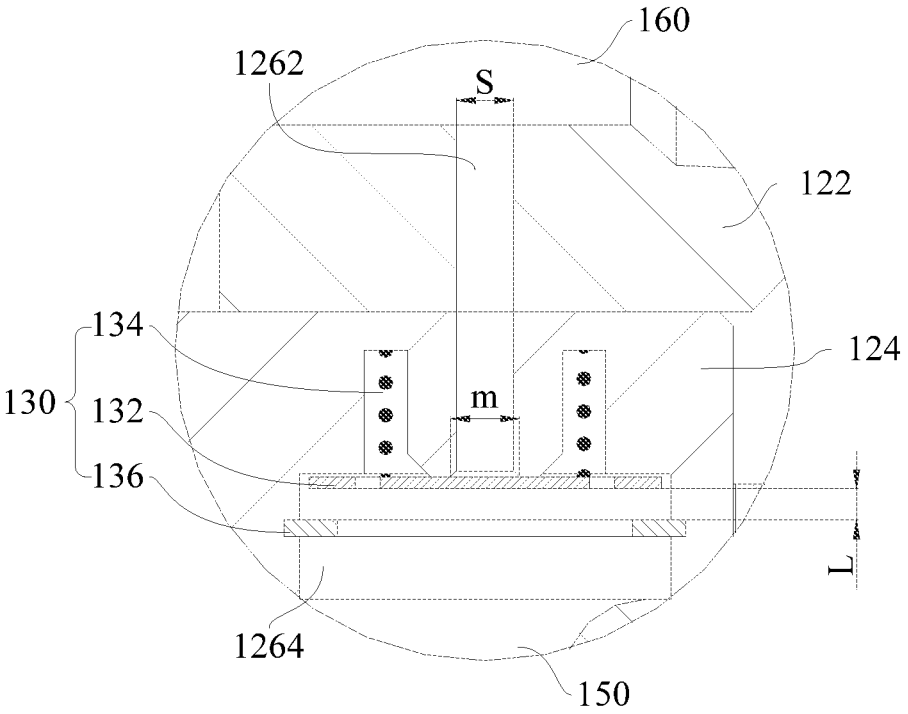
FIG. 3 is a schematic view of the structure of a pressure relief device of a compressor according to an embodiment of the present disclosure.
Figure 4:
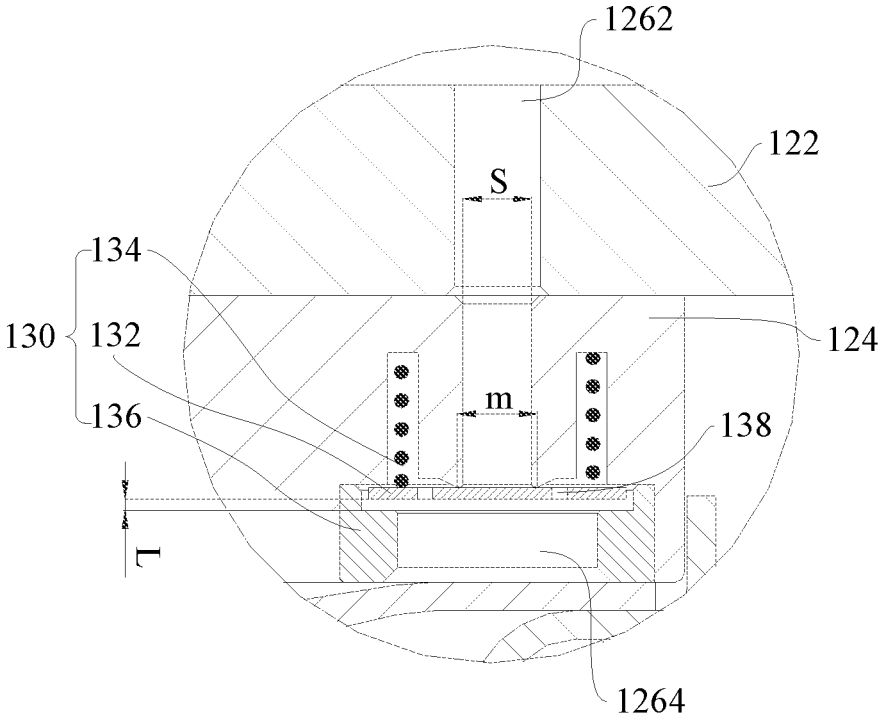
FIG. 4 is a schematic view of the structure of a pressure relief device of a compressor according to another embodiment of the present disclosure.
Figure 5:
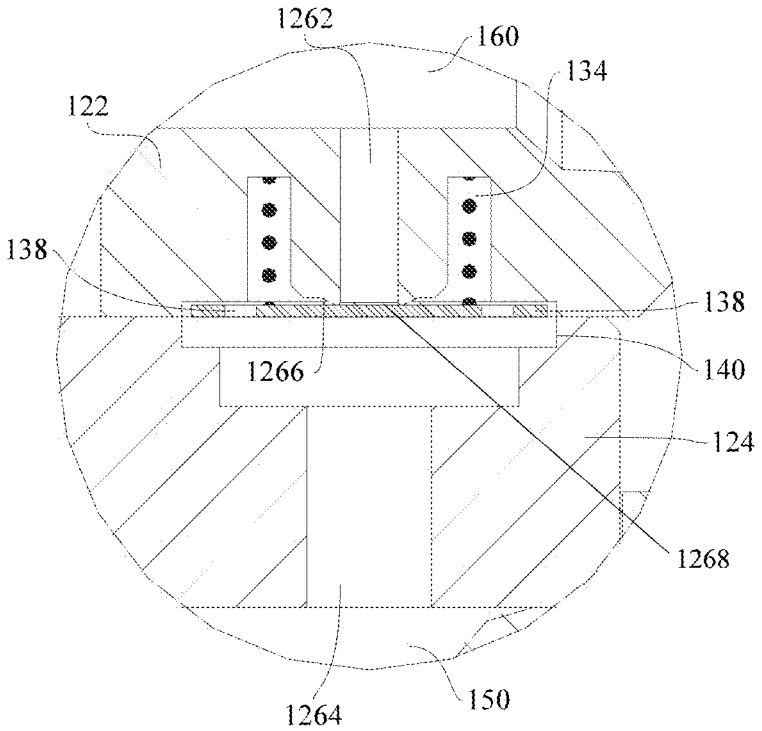
FIG. 5 is a schematic view of the structure of a pressure relief device of a compressor according to another embodiment of the present disclosure.

As shown in FIGS. 3-5, another exemplary embodiment according to the present disclosure may comprise the features defined in any one of the above embodiments, and furthermore, the pressure relief device 130 comprises a pressure relief piece 132 and an elastic piece 134.

For example, the pressure relief piece 132 can be moveably disposed on the pressure relief opening 1268 of the pressure relief channel 126. An elastic piece 134 is mounted on the air cylinder assembly 120 and connected with the pressure relief piece 132, so as to drive the pressure relief piece 132 to move in the axis direction of the pressure relief channel 126, and further open or close the pressure relief opening 1268.

In this exemplary embodiment, the movement of the pressure relief piece 132 is controlled by the elastic piece 134. When the actual pressure difference between the air suction cavity 160 and the containing cavity 150 is greater than the elastic force of the elastic piece 134, the pressure relief piece 132 is pushed by the pressure in the containing cavity 150 to a first position, and the pressure relief piece 132 contacts the pressure relief opening 1268 and closes the pressure relief channel 126. When the actual pressure difference between the air suction cavity 160 and the containing cavity 150 is smaller than the elastic force of the elastic piece 134, the elastic piece 134 pushes the pressure relief piece 132 to move from the first position to a second position, the pressure relief channel 126 is opened, and with the movement of the pressure relief piece 132, the pressure relief piece 132 gradually moves away from the pressure relief opening 1268. Thus, the pressure in the containing cavity 150 and the pressure in the air suction cavity 160 can be adjusted rapidly and a balance between them is reached, thereby meeting the condition for restarting the compressor 100.

Furthermore, the second position can be determined by the elastic force of the elastic piece 134, and a position-limiting piece 136 can also be disposed on the air cylinder assembly 120, and then the second position is defined by the position-limiting piece 136, and thus the position of the pressure relief piece 132 in the axis direction of the pressure relief channel 126 is limited.

For example, the position-limiting piece 136 can be a retainer ring structure, as shown in FIG. 3, or a limit block structure, as shown in FIG. 4. As shown in FIG. 3, when the position-limiting piece 136 is disposed to be the retainer ring structure, it is assembled in a pre-processed retaining groove in the air cylinder assembly 120, to prevent the pressure relief piece 132 and the elastic piece 134 from flying out, and through the positioning by the retaining groove, the second position of the pressure relief piece 132 can be controlled. As shown in FIG. 4, when the position-limiting piece 136 is disposed to be the limit block structure, the limit block can be assembled in the pre-processed hole in the air cylinder assembly 120, and fixed by interference fit or threaded structure or etc., thus the pressure relief piece 132 and the elastic piece 134 are prevented from flying out, and through the design of the limit block structure, the second position of the pressure relief piece 132 can be controlled. In addition, the number of the position-limiting piece 136 can be one or multiple, and the multiple position-limiting pieces 136 are arranged with an interval there-between.

It can be understood that in order to facilitate the connection between the elastic piece 134 and the air cylinder assembly 120, a base 140 for fixing the elastic piece 134 can be disposed at the pressure relief opening 1268, and thus the connection strength between the elastic piece 134 and the air cylinder assembly 120 is enhanced through the base 140. Therefore, the stability of the pressure relief device 130 in a pressure relief process is ensured, which facilitates quick balance of the pressure difference between the air suction cavity 160 and the containing cavity 150.

As shown in FIGS. 3 and 5, another exemplary embodiment according to the present disclosure may comprise the features defined in any one of the above embodiments, and furthermore, the pressure relief piece 132 is provided with at least one through-flow hole 138.

In this exemplary embodiment, when the pressure relief piece 132 is at the second position (i.e., when the pressure relief piece 132 has the maximum displacement relative to the pressure relief opening 1268), the pressure relief piece 132 reaches the position-limiting piece 136, as it circumferentially contacts the position-limiting piece 136, which makes flow difficult. Therefore, in order to ensure the smooth circulation of the pressure relief channel 126, one or more through-flow holes are disposed in the pressure relief piece 132.

For example, the through-flow holes are disposed outside the contact portion of the pressure relief piece 132 and the pressure relief opening 1268 and inside the contact portion of the pressure relief piece 132 and the position-limiting piece 136. In other words, the arrangement of the positions of the through-flow holes can satisfy both the area of the pressure relief piece 132 that does not communicate with the pressure relief opening 1268 when the pressure relief piece 132 closes the pressure relief channel 126, and the area that is not in contact with the position-limiting piece 136 when the pressure relief piece 132 is in contact with the position-limiting piece 136. Thus, it can be ensured that no leakage occurs when the pressure relief piece 132 is closely attached to the pressure relief opening 1268, and in addition, it can also be ensured that the circulation effect of the pressure relief channel 126 can still be achieved through the through-flow holes when the position-limiting piece 136 is in contact with the pressure relief piece 132.

Figure 6:
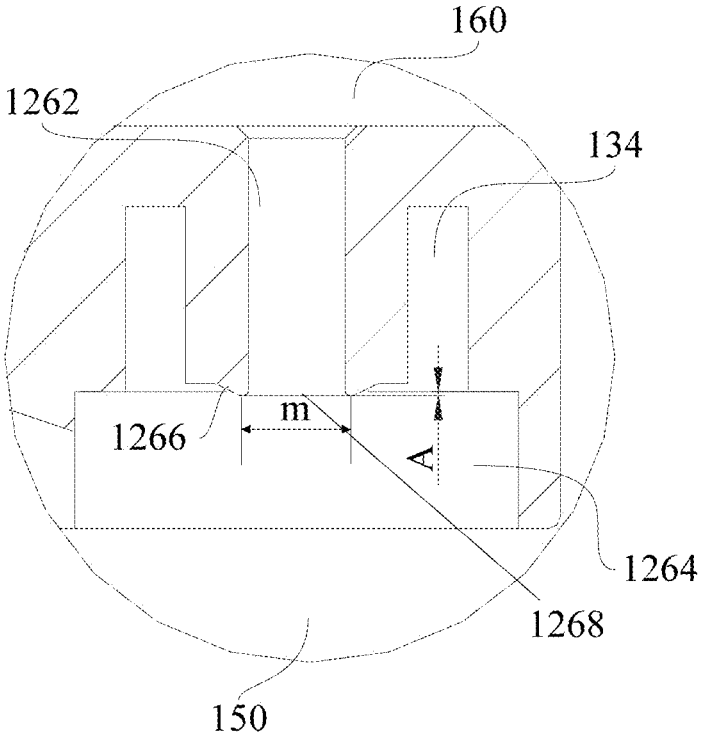
FIG. 6 is a schematic view of the structure of a pressure relief device of a compressor according to another embodiment of the present disclosure.
Figure 7:
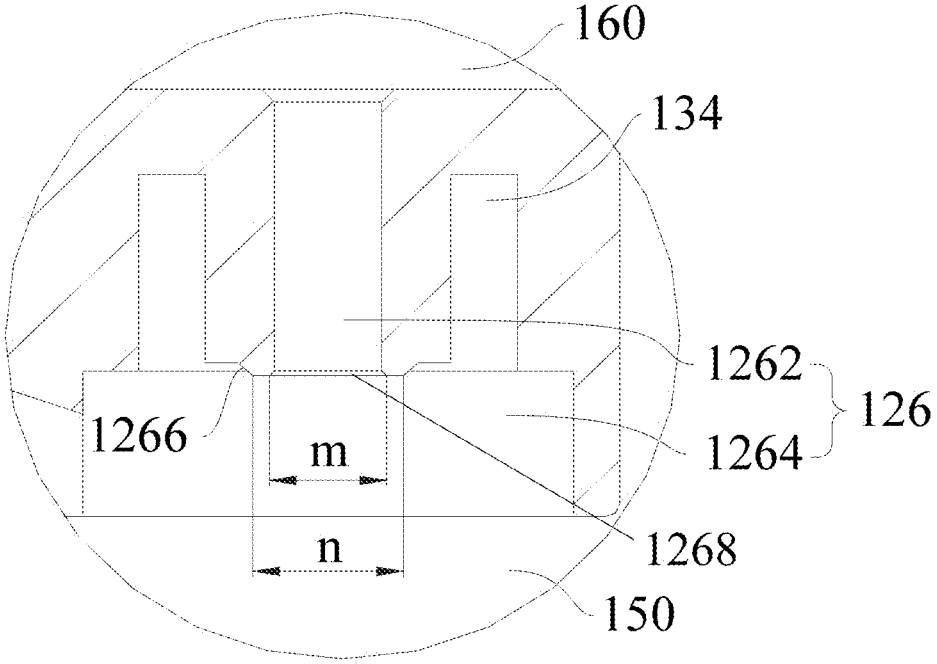
FIG. 7 is a schematic view of the structure of a pressure relief device of a compressor according to another embodiment of the present disclosure.

As shown in FIGS. 6 and 7, another exemplary embodiment according to the present disclosure may comprise the features defined in any one of the above embodiments, and furthermore, the pressure relief channel 126 is disposed with a protruding structure 1266.

For example, along the axis direction of the pressure relief channel 126, the pressure relief channel 126 is disposed with the protruding structure 1266, and the protruding structure 1266 protrudes towards a direction from the air suction cavity 160 to the containing cavity 150, and the height of protruding (unit: mm) is represented by A; a platform is formed at a side of the protruding structure 1266 that is close to the containing cavity 150; and the pressure relief opening 1268 is disposed in the platform. The elastic piece 134 can be a spring.

In this exemplary embodiment, by disposing the protruding structure 1266 on the pressure relief channel 126, the pressure relief opening 1268 protrudes relative to the air cylinder assembly 120. When the pressure relief piece 132 reaches the first position, since the pressure relief opening 1268 protrudes from peripheral steps, the pressure relief piece 132 can effectively contact the pressure relief opening 1268, thereby preventing the tilting of the pressure relief piece 132 from affecting the effect that the pressure relief piece 132 closes the pressure relief channel 126. The height A of the protruding structure can be reasonably arranged according to the requirements for production or pressure adjustment.

Furthermore, as shown in FIG. 5, the diameter of the pressure relief opening 1268 is smaller than or equal to the diameter of the platform. As the elastic piece 134 is compressed by the high-pressure side of the pressure relief device 130, the pressure relief piece 132 gradually approaches the pressure relief opening 1268 until the pressure relief opening 1268 is closed. When the pressure relief piece 132 closes the pressure relief opening 1268 (i.e., the pressure relief piece 132 is at the first position), at this moment, if the diameter of the pressure relief opening 1268 is equal to the diameter of the platform, the pressure relief piece 132 is in line contact with the platform and the elastic force Ft (unit: N) of the elastic piece 134 satisfies: $0<Ft\leq a\times m2$, wherein, m (unit: mm) represents the diameter of the pressure relief opening 1268, and the value range of a is 0.6~0.9; if the diameter of the pressure relief opening 1268 is smaller than the diameter of the platform, the pressure relief piece 132 is in surface contact with the platform and the elastic force Ft of the elastic piece 134 satisfies: $0<Ft\leq b\times(m+n)2$, wherein, m represents the diameter of the pressure relief opening 1268, n represents the diameter of the platform, and the value range of b is 0.15~ 0.25. Therefore, the pressure difference for controlling the pressure relief piece 132 to open the pressure relief channel 126 (the pressure difference between the inner space of the containing cavity 150 and the air suction cavity 160) is fully considered. The greater the pressure difference between the inner space of the containing cavity 150 and the air suction cavity 160 is, the greater the elastic force of the elastic piece 134 should be. The conditions that affect the design of the elastic force also include factors, such as the viscous force of the lubricating oil existing between the pressure relief piece 132 and the platform when the pressure relief piece 132 contacts the pressure relief opening 1268. By limiting the elastic force of the elastic piece 134, the pressure relief device 130 can meet the requirement for achieving rapid pressure balance after the compressor 100 is shut down in various application situations of refrigerating and heating, so that the compressor 100 can meet the requirements of different application situations, thereby solving the problem of restarting after the compressor 100 is shutdown.

It needs to be explained that if the elastic force of the elastic piece 134 is designed relatively large, it means that a relatively large pressure difference is required to make the pressure relief piece 132 close the pressure relief channel 126. In other words, if the pressure difference of the compressor 100 in an operating condition is smaller than the pressure difference for closing the pressure relief piece 132, the pressure relief piece 132 is also in an open state while the compressor 100 is operating, which will cause collusion of the high pressure and the low pressure of the compressor 100, thus affecting the operating efficiency of the compressor 100. For example, for a compressor 100 operating in a working condition with a small pressure difference, a can be set to 0.6, that is, the elastic force Ft of the elastic piece 134 can be set to satisfy $0<Ft\leq 0.6\times m^2$, or b is set to 0.15, i.e., $0<Ft\leq 0.15\times(m+n)^2$; for a compressor 100 used in normal working conditions, a can be set to 0.9, that is, the elastic force Ft of the elastic piece 134 can be set to satisfy $0<Ft\leq 0.9\times m^2$, or b is set to 0.25, i.e., $0<Ft\leq 0.25\times(m+n)^2$. Therefore, the requirement is met that the pressure relief piece 132 is in a closed state under most operating conditions of the compressor 100, and the requirement for the balance between the high-pressure side and the low-pressure side of the compressor 100 within a specified time limit after the compressor 100 is shut down can also be met, and then consideration can be given to both the requirements for the operating efficiency and the pressure balance of the compressor 100.

For example, if the pressure relief opening 1268 is disposed to be in a circular shape, the pressure relief opening 1268 has a diameter m when it contacts the pressure relief piece 132. If the pressure relief opening 1268 is in a non-circular shape, the area enclosed by the pressure relief opening 1268 can also be calculated, and then the diameter of a circle with the same area can be converted.

As shown in FIGS. 3 and 4, another exemplary embodiment according to the present disclosure may comprise the features defined in any one of the above embodiments, and furthermore, the displacement L of the pressure relief device 130, i.e., the distance that the pressure relief device 130 moves from the first position to the second position, satisfies: $0<L\leq 1$ mm.

In this exemplary embodiment, after the pressure relief piece 132 leaves the pressure relief opening 1268, the acting force of the elastic piece 134 on the pressure relief piece 132 will decrease as the displacement of the pressure relief piece 132 increases. If the acting force changes sharply, it will cause relatively large differences between multiple pressure differences required for closing the pressure relief channel 126 when the pressure relief piece 132 is at different positions, and then lead to unstable movement of the pressure relief piece 132, and further cause problems such as impact, abrasion and noise. Therefore, the distance, by which the pressure relief device 130 moves from the first position to the second position (i.e., the maximum displacement between the pressure relief piece 132 and the pressure relief opening 1268), cannot be too large, and then by setting the displacement L of the pressure relief device 130 to satisfy: $0<L\leq 1$ mm, the stability of the pressure relief piece 132 during the movement is ensured, so as to facilitate quick decompressing.

The displacement L can be set reasonably according to the design parameters of the elastic piece 134 and the structure and the dimension of the compressor 100.

As shown in FIG. 2, another exemplary embodiment according to the present disclosure may comprise the features defined in any one of the above embodiments, and furthermore, the air cylinder assembly 120 comprises the air cylinder 122, the bearing 124 and the silencer 128.

For example, the air cylinder 122 is disposed inside the containing cavity 150, and the air cylinder 122 comprises an air cylinder body 1222, a slider (not shown in the drawings), a piston 1224 and an eccentric crankshaft 1226. The piston 1224 is disposed in the air cylinder body 1222, and the eccentric crankshaft 1226 passes through the air cylinder body 1222. The bearing 124 is connected to the two sides of the air cylinder 122 and the eccentric crankshaft 1226 is supported by the bearing 124. The air cylinder 122 and the bearing 124 enclose the air suction cavity 160, and the air suction cavity 160 communicates with the air suction opening in the shell 110, so as to discharge the refrigerant inside the air suction cavity 160 out of the shell 110. The pressure relief device 130 is connected with either the air cylinder 122 or the bearing 124, and the pressure relief device 130 can be disposed at either side of the air suction cavity 160 or at both sides of the air suction cavity 160 at the same time. The silencer 128 is disposed on the bearing 124, and the silencer 128 and the bearing 124 enclose the silencing cavity. The pressure relief channel 126 is disposed in the air cylinder 122 and the bearing 124, and the two ends of the pressure relief channel 126 respectively communicate with the air suction cavity 160 and the silencing cavity.

In this exemplary embodiment, through the revolution of the piston 1224 and the reciprocating motion of the slider, the process of air intaking, compressing and exhausting of the compressor 100 is realized, that is, a working cycle is accomplished. In addition, by disposing the silencer 128 to reduce the noise produced while adjusting the pressures in the air suction cavity 160 and the containing cavity 150, the discomfort caused to users during the application of the compressor 100 is reduced, and the practicability of the compressor 100 is improved.

For example, when the compressor 100 stops working, the piston 1224 stops at a position in the air cylinder body 1222, and the piston 1224 is in clearance fit with the air cylinder body 1222, so that the pressure in the containing cavity 150 and the air suction cavity 160 can be adjusted through the clearance between the piston 1224 and the air cylinder body 1222. In a refrigerating application, the refrigerant gas can be leaked from the clearance to balance the pressure in the compressor 100, and the refrigerant gas is leaked from a side with a relatively high pressure to a side with a relatively low pressure so as to balance pressure; it may also be the situation where the oil at the side with a relatively high pressure is leaked to the side with a relatively low pressure, and the refrigerant dissolved in the oil escapes, so as to increase the ambient pressure at the side with a relatively low pressure, so that the pressure of the compressor 100 is balanced.

Furthermore, a main bearing and an auxiliary bearing are contained, and the main bearing and the auxiliary bearing are respectively disposed at the opposite sides of the air cylinder 122. When the main bearing is disposed with main bearing exhaust holes, a main bearing silencer 128 is disposed on the main bearing. Similarly, when the auxiliary bearing is disposed with auxiliary bearing exhaust holes, an auxiliary bearing silencer 128 can be disposed on the auxiliary bearing. The number of the exhaust holes disposed in the main bearing or in the auxiliary bearing can be multiple. By providing a plurality of exhaust holes, when the pressure relief device 130 opens the pressure relief channel 126, the performance degradation can be suppressed, and at the same time, the risk of reliability caused by the rising of the temperature of the exhaust gas due to the reflux of the pressure relief device 130 can be avoided.

For example, if the pressure relief channel 126 comprises the first pressure relief channel 1262 and the second pressure relief channel 1264, as shown in FIG. 5, the first pressure relief channel 1262 can be opened in the air cylinder 122, and as shown in FIG. 3 and FIG. 4, the first pressure relief channel 1262 can also be opened in the air cylinder 122 and the bearing 124 at the same time. The area of the cross section of a portion of the first pressure relief channel 1262 in the air cylinder 122 is the same as or different from the area of the cross section of a portion of the first pressure relief channel 1262 in the bearing 124. Similarly, the second pressure relief channel 1264 can be opened in the bearing 124 or opened in the air cylinder 122 and the bearing 124 at the same time.

As shown in FIG. 1 and FIG. 2, according to another exemplary embodiment of the present disclosure, a rotary compressor 100 is provided. The rotary compressor 100 comprises: the shell 110 and an enclosed space (the containing cavity 150) enclosed by the shell 110; and a compressor structure, wherein the compressor structure is disposed in the shell 110, and the compressor structure comprises the air cylinder 122, the main bearing, the auxiliary bearing, the pressure relief channel 126 and the pressure relief device 130; the main bearing and the auxiliary bearing are respectively disposed at the opposite sides of the air cylinder 122; the air cylinder 122 comprises the air suction cavity 160; and the air suction cavity 160 communicates with the space at the air suction side of the compressor 100. The air cylinder 122 comprises an air cylinder body 1222, a piston 1224 and a slider provided in the air cylinder body 1222, and an eccentric crankshaft 1226 connected with the air cylinder body 1222; exhaust holes are disposed in the main bearing, and correspondingly an exhaust-silencing cavity enclosed by an upper silencer 128 is provided in the main bearing. Similarly, if exhaust holes are disposed in the auxiliary bearing, a lower silencer 128 is mounted, thereby forming an exhaust-silencing cavity.

As shown in FIGS. 3-5, the pressure relief channel 126 communicates with the air suction cavity 160 and the space in the shell 110; the pressure relief device 130 has a valve sheet (the pressure relief piece 132) and a spring (the elastic piece 134); and the pressure relief device 130 is configured to open or close the pressure relief channel 126 by the movement of the valve sheet. The pressure relief device 130 can be disposed at one side of the main bearing, or at one side of the auxiliary bearing, or at both sides of the pressure relief device 130 at the same time. A high-pressure side pressure relief channel 126 (the second pressure relief channel 1264) communicates with the space within the shell 110, and a low-pressure side pressure relief channel 126 (the first pressure relief channel 1262) communicates with the air suction cavity 160. When the pressure relief channel 126 is closed, the valve sheet is closely attached to the valve base (the base 140) on the top of the pressure relief channel 126 and thus closes the circulation from the high-pressure side pressure relief channel 126 to the low-pressure side pressure relief channel 126. The high-pressure side pressure relief channel 126 communicates with the high pressure of the high-pressure internal space of the shell 110, while the low-pressure side pressure relief channel 126 communicates with the low pressure in the air suction cavity 160, and under the action of the pressure difference between high and low-pressure side pressure relief channels 126, the valve sheet is closely attached to the valve base to close the pressure relief channel 126. The spring has an acting force on the valve sheet, and the acting force drives the valve sheet to leave the valve base and thus the pressure relief channel 126 is opened.

When the pressure relief channel 126 is opened, the valve sheet moves to leave the valve base. If the low-pressure side pressure relief channel 126 has a minimum cross-sectional area S, the minimum perimeter of position where the valve sheet contacts the valve base is Z, the valve sheet has the maximum displacement L when the pressure relief channel 126 opens, and then when the valve sheet opens to the maximum extent, the circumferential through-flow area from the high-pressure side pressure relief channel 126 to the low-pressure side pressure relief channel 126 is defined to satisfy: $Sz=Z\times L$, and then satisfy: $0<Sz\leq 0.8\times S$. When the fluid flows from the high-pressure side pressure relief channel 126 to the low-pressure side pressure relief channel 126, a certain throttling effect will be produced when it passes through the circumferential through-flow area Sz, and therefore, the pressure distribution of the fluid on both sides of the valve sheet is conducive to the stability of the valve sheet.

For example, in the design of the valve base, in order to ensure that the valve sheet can effectively close the pressure relief channel 126, the valve base needs to be designed to protrude relatively. As shown in FIGS. 5 and 6, when the valve sheet is closely attached to the valve base, the valve sheet is disposed with steps (the protruding structure) in the circumferential direction to prevent the tilting of the valve sheet from affecting the effect of the valve sheet in closing the pressure relief channel 126. Therefore, the valve base is disposed higher than the peripheral steps, that is, the dimension A in FIG. 6 is set to be $A>0$, so as to ensure the effective contact between the valve sheet and the valve base.

Furthermore, when the valve sheet leaves the valve base, the acting force of the spring on the valve sheet will decrease as the stroke of the valve sheet increases. If the acting force changes sharply, this will render great difference in the pressure difference for closing required by the valve sheet at different positions, and then lead to unstable movement of the valve sheet, and further cause problems such as impact, abrasion and noise. Therefore, the stroke L of the valve sheet cannot be too large, and fine practical effect can be achieved when the stroke is designed to satisfy $0<L\leq 1$ mm in combination with the design parameters of the spring and the structure and the dimension of the rolling rotor compressor 100.

In order to achieve better manufacturability for the compressor 100, the pressure relief device 130 can be pre-assembled on the air cylinder 122 or the bearing 124 to become a part of the air cylinder 122 or the bearing 124. In this case, the assembly and the manufacturability of the compressor 100 will not be affected due to the addition of the pressure relief device 130. Therefore, a position-limiting device (the position-limiting piece 136) is disposed, and the valve sheet and the spring are pre-assembled on the air cylinder 122 or the bearing 124 through the position-limiting device. The position-limiting device can be a retainer ring structure as shown in FIG. 3, or a limit block structure as shown in FIG. 4.

As shown in FIG. 3, when the position-limiting device is disposed to be the retainer ring structure, it is assembled in a pre-processed retaining groove, to prevent the valve sheet and the spring from flying out, and through the positioning of the retaining groove, the stroke (displacement) L of the valve sheet can be controlled. As shown in FIG. 4, when the position-limiting device is disposed to be the limit block structure, the limit block can be assembled in the pre-processed hole, and fixed by interference fit or threaded structure or etc., thereby preventing the valve sheet and the spring from flying out, and through the design of the limit block structure, the stroke L of the valve sheet can be controlled.

When the valve sheet has the maximum stroke, it reaches the position of the position-limiting device, and it is difficult to flow due to the circumferential contact with the position-limiting device. Therefore, in order to ensure the smooth circulation of the pressure relief channel 126, through-flow holes are disposed in the valve sheet, and are disposed outside the contact portion between the valve sheet and the valve base and inside the contact portion between the valve sheet and the position-limiting device. Thus, this can not only ensure that no leakage occurs when the valve sheet is closely attached to the valve base, but also ensure that the circulation effect of the pressure relief channel 126 can still be achieved through the through-flow holes when the valve sheet is at the position of the position-limiting device.

Furthermore, when the valve sheet is closely attached to the valve base, the spring is compressed and has an elastic force Ft (unit: N), and the elastic force acts on the valve sheet and tends to drive the valve sheet to leave the valve base. The contact portion between the valve sheet and the valve base is line contact theoretically, that is, the top of the valve base is an arc structure. As shown in FIGS. 6 and 7, under normal circumstances, the valve sheet is in a circular shape, at this moment, the contact portion has a diameter m (unit: mm), if the contact portion is in a non-circular shape, the area enclosed by the contact portion can also be calculated, and then the diameter m of a circle with the same area can be converted. If the relationship between the elastic force Ft and the diameter m is disposed to satisfy: $0<Ft\leq 0.9\times m^2$, the valve sheet is in surface contact with the valve base, and the contact portion has an inner diameter m and an outer diameter n, and the relationship satisfies: $0<Ft\leq 0.25\times(m+n)^2$.

When the elastic force Ft in the case of closing the pressure relief channel 126 is designed, a target pressure difference (the pressure difference between the high-pressure inner space in the shell 110 and the air suction holes) for opening the pressure relief device 130 needs to be taken into consideration. If the target pressure difference is large, the elastic force Ft is designed to increase accordingly. In addition, it is also necessary to consider the viscous force of the lubricating oil existing between the valve sheet and the valve base and etc. when the valve sheet contacts the valve seat. To sum up, in the case of $0<Ft\leq 0.9\times m^2$ or $0<Ft\leq 0.25\times(m+n)^2$, the pressure relief device 130 can meet the requirement for quick pressure balance, for example, within 3 minutes, when the compressor 100 is applied in various application situations of refrigerating and heating after it is shut down, so that the rotary compressor 100 can meet the requirements of different application situations, thereby solving the problem of restarting after the rotary compressor 100 is shutdown.

In addition, when the compressor 100 is provided with the pressure relief device 130, if the elastic force Ft is designed relatively large, it also means that a relatively large pressure difference is required to close the pressure relief device 130. In other words, if the pressure difference of the compressor 100 in an operating condition is smaller than the pressure difference for closing the pressure relief device 130, and the pressure relief device 130 is also in the open state while the compressor 100 is operating, which will cause collusion of the high pressure and the low pressure of the compressor 100, and thus affect the operating efficiency of the compressor 100. Therefore, for the compressor 100 used in an operating condition with a small pressure difference, when the pressure relief device 130 of the present disclosure is disposed, the elastic force Ft can be set to $0<Ft\leq 0.6\times m^2$, or $0<Ft\leq 0.15\times(m+n)^2$, so as to meet the requirement that the pressure relief device 130 is in the closed state under most operating conditions of the compressor 100, and the requirement for the balance between the high-pressure side and the low-pressure side of the compressor 100 after the compressor is shutdown can also be met, and thus consideration is given to both the requirements for the operating efficiency and the pressure balance of the compressor 100.

In this exemplary embodiment, the rotary compressor 100 can greatly shorten the restarting time of the compressor 100 after it is shut down, and thus the refrigeration system can be restarted again, and the effect of the refrigeration system can be improved.

As shown in FIG. 1, according to another exemplary embodiment of a second aspect of the present disclosure, a refrigeration system is provided, and the refrigeration system comprises a compressor 100 and a heat exchanger 200 provided in the first aspect, and the heat exchanger 200 is connected with the air suction cavity of the compressor 100. Therefore, the refrigeration system has all the beneficial effects of the compressor provided in the first aspect, and will not be repeated herein.

Furthermore, the refrigeration system further comprises a non-return piece (not shown in the drawings). The non-return piece is configured to block the refrigerant in the air suction cavity from being discharged out of the shell of the compressor through the air suction opening of the compressor. Therefore, the pressure in the shell is prevented from being discharged through the air suction opening, which is conducive to the maintenance of pressure, and helps to realize the pressure adjusting function of the compressor.

For example, the refrigeration system can be applied to refrigeration devices, such as air conditioners and refrigerators.

In the present disclosure, the term of "first" and "second" are used only for the purpose of description and shall not be understood to indicate or imply any relative importance, unless otherwise clearly defined. The terms "connected with", "mounting", "fix" and the like should be understood in a broad sense, for example, the term "connected with" can be a fixed connection, a detachable connection, or an integral connection, and can be a direct connection or an indirect connection through an intermediate medium. For a person skilled in the art, they may understand the specific meanings of the above-mentioned terms in the present disclosure according to specific circumstances.

In the specification of the present disclosure, the description by the terms of "an embodiment", "some embodiments", "specific embodiment" and the like means that the specific features, structures, materials or characteristics described in combination with the embodiments or examples are contained in at least one embodiment or example of the present disclosure. In the specification, the illustrative expressions of the above terms may not indicate the same embodiments or examples. In addition, the specific features, structures, materials or characteristics as described may be combined in an appropriate method in one or more of any embodiments or examples.

The above-mentioned are merely some preferred embodiments of the present disclosure and not intended to limit the present disclosure, and for one skilled in the art, various modifications and changes may be made to the present disclosure. Any modifications, equivalent substitutions, improvements and so on made within the spirit and principle of the present disclosure should be covered within the scope of protection of the present disclosure.

What is claimed is:

1. A compressor comprising:

a shell, wherein the shell comprises a containing cavity;

an air cylinder assembly disposed in the containing cavity, wherein the air cylinder assembly comprises an air suction cavity and a pressure relief channel, wherein the pressure relief channel communicates with the air suction cavity and the containing cavity, wherein the pressure relief channel comprises a pressure relief opening; and a pressure relief device connected with the air cylinder assembly, wherein the pressure relief device moves along a longitudinal axis of the pressure relief channel to open or close the pressure relief opening;

wherein a through-flow area of the pressure relief device satisfies: $0<Sz\leq 0.8\times S$, wherein Sz represents the through-flow area of the pressure relief device, and S represents the area of the cross section of the pressure relief channel, and wherein Sz is $L\times Z$, wherein L is a displacement of the pressure relief device, and Z is a circumference of the pressure relief opening.

2. The compressor according to claim 1, wherein the pressure relief channel comprises:

a first pressure relief channel having a first end and a second end, wherein the first end of the first pressure relief channel communicates with the air suction cavity; and a second pressure relief channel having a first end and a second end, wherein the first end of the second pressure relief channel communicates with the second end of the first pressure relief channel, and the second end of the second pressure relief channel communicates with the containing cavity;

wherein:

the pressure relief device is located between the first pressure relief channel and the second pressure relief channel; and the through-flow area satisfies: $0<Sz\leq 0.8\times S1$, wherein Sz represents the through-flow area of the pressure relief device, and S1 represents the area of the cross section of the first pressure relief channel.

3. The compressor according to claim 2, wherein the pressure relief device comprises:

a pressure relief piece, moveably disposed on the pressure relief opening of the pressure relief channel; and an elastic piece connected with the air cylinder assembly and the pressure relief piece, wherein the elastic piece is configured to drive the pressure relief piece to move to open or close the pressure relief opening.

4. The compressor according to claim 3, wherein the pressure relief device further comprises a position-limiting piece connected with the air cylinder assembly, wherein the position-limiting piece is configured to limit the position of the pressure relief piece along the longitudinal axis of the pressure relief channel.

5. The compressor according to claim 3, wherein the pressure relief piece is provided with at least one through-flow hole.

6. The compressor according to claim 3, wherein: along the longitudinal axis of the pressure relief channel, the pressure relief channel is provided with a protruding structure that protrudes towards the containing cavity, the protruding structure comprises a platform facing the containing cavity, and the platform is provided with the pressure relief opening.

7. The compressor according to claim 6, wherein: the elastic piece is compressed in response to the pressure relief piece closing the pressure relief opening; and the elastic force of the elastic piece satisfies: $0<Ft\leq a\times m^2$, or $0<Ft\leq b\times(m+n)^2$, wherein Ft represents the elastic force of the elastic piece, m represents the diameter of the pressure relief opening, n represents the diameter of the platform, the value range of a is 0.6-0.9, and the value range of b is 0.15-0.25.

8. The compressor according to claim 1, wherein the displacement L of the pressure relief device satisfies: $0<L\leq 1$ mm.

9. The compressor according to claim 1, wherein:

the shell is provided with an air suction opening;

the air cylinder assembly comprises an air cylinder and a bearing;

the air cylinder is disposed inside the containing cavity, the bearing is disposed at two sides of the air cylinder, the air cylinder and the bearing enclose the air suction cavity, and the air suction cavity communicates with the air suction opening;

the pressure relief channel is disposed in the air cylinder and the bearing; and the pressure relief device is connected with the air cylinder or the bearing.

10. The compressor according to claim 9, wherein the air cylinder assembly further comprises:

a silencer connected with the bearing, wherein the silencer and the bearing enclose a silencing cavity; and two ends of the pressure relief channel communicate with the air suction cavity and the silencing cavity, respectively.

11. A refrigeration system comprising:

a compressor according to claim 1; and a heat exchanger connected with the air suction cavity of the compressor.

12. The refrigeration system according to claim 11, further comprising a non-return piece, wherein the non-return piece is configured to block a refrigerant in the air suction cavity from being discharged out of the shell of the compressor through the air suction opening of the compressor.

13. The compressor according to claim 1, wherein the pressure relief channel is linear.

* * * * *